United States Patent [19]

Rutens

[11] Patent Number: 4,991,894

[45] Date of Patent: Feb. 12, 1991

[54] CARRYING HANDLE

[76] Inventor: John Rutens, 31-50 104th St., Linden Hill, N.Y. 11354

[21] Appl. No.: 478,257

[22] Filed: Feb. 9, 1990

Related U.S. Application Data

[63] Continuation-in-part of Ser. No. 411,843, Sep. 25, 1989, abandoned.

[51] Int. Cl.[5] ..... B65D 33/06

[52] U.S. Cl. ..... 294/170; 294/137

[58] Field of Search ..... 294/26, 27.1, 33, 137, 294/141-143, 145, 153, 154, 158, 166, 167, 170, 171; 16/114 R, 124-126; 220/91, 92, 94 R, 95; 229/117.09, 117.19, 117.21, 117.23-117.25; 383/6, 13, 15, 25, 26, 29

[56] References Cited

U.S. PATENT DOCUMENTS

| | | | |
|---|---|---|---|
| 270,917 | 1/1883 | Turner | 294/170 |
| 587,634 | 8/1897 | Archbold | 294/137 |
| 606,936 | 7/1898 | Ottignon | 294/137 |
| 787,520 | 4/1905 | Linn | 294/170 |
| 891,710 | 6/1908 | Lane | 294/170 |
| 2,522,833 | 9/1950 | Maccaferri | 294/170 X |
| 2,540,068 | 1/1951 | Williamson | 294/170 X |
| 2,567,788 | 9/1951 | Salmon | 294/33 |
| 2,684,797 | 7/1954 | Schulte | 294/170 X |
| 3,797,876 | 3/1974 | Gummelt | 294/170 X |
| 4,772,059 | 9/1988 | Parry et al. | 294/170 |

FOREIGN PATENT DOCUMENTS

| | | | |
|---|---|---|---|
| 84143 | 8/1954 | Norway | 294/170 |
| 153190 | 1/1956 | Sweden | 294/170 |
| 224527 | 3/1943 | Switzerland | 294/170 |
| 11099 | of 1884 | United Kingdom | 294/170 |
| 371015 | 4/1932 | United Kingdom | 294/27.1 |

*Primary Examiner*—Johnny D. Cherry

*Attorney, Agent, or Firm*—Collard, Roe & Galgano

[57] ABSTRACT

A carrying handle for supporting a shopping bag and its contents comprising a central portion having a first end and a second end, a first end member integrally attached at the first end, a second end member integrally attached at the second end, the central portion being an arc with a large radius of curvature, each of the first and second end members being J-shaped comprising an arc with a small radius of curvature, joined to a straight arm portion. The first and second end members are directed inwardly toward each other. The central portion and the end members are all in the same plane. The central portion curves toward the J-shaped members, and each of the J-shaped members curve toward the central portion, By inserting an intermediate section between the central portion and the end member, and by having the end member U-shaped, a second embodiment is provided.

1 Claim, 2 Drawing Sheets

CARRYING HANDLE

CROSS REFERENCE TO RELATED APPLICATION

This is a continuation-in-part application of copending U.S. patent application Ser. No. 411,843 filed Sept. 25, 1989, now abandoned.

BACKGROUND OF THE INVENTION

1. Field of the Invention

The present invention relates to a carrying handle for a shopping bag, in which the handle is a continuously curvilinear combination of arcs having different radii of curvative yet integrally joined together.

2. The Prior Art

Retail businesses sometimes provide plastic shopping bags for their customers, in which bags are placed some, or all, of the various products purchased by the customer. In a supermarket, the customer may purchase several products in cans which when placed in one plastic shopping bag result in a total weight that is relatively quite heavy, possibly up to 10 or 15 pounds. The plastic bag is constructed with two built-in handles that are grasped by the purchaser when he or she leaves the check-out counter to exit the store. Many times each of the handles on the bags becomes crimped together, and each handle becomes quite narrowed in width. The net result is that the weight per unit area supported by each handle is increased by a large factor, such as by 5 to 10 times the original value.

This greatly increased carrying load has been known to cause injury to the fingers and hand of the purchaser, especially if the customer has physical infirmities, such as arthritis, or any other type of joint disease.

In the prior art patents, attempts have been made in the past to overcome these difficulties. The Schulte U.S. Pat. No. 2,684,797 discloses a package or shopping bag handle that consists of a body portion, generally of arcuate shape, onto which are formed at each end hooks, shaped in the form of hammer claws. These ends, or hammer claws, are directed opposite to each other enlarging the size of the handle and serve to hold the cords of a shopping bag. These hammer claws are not directed inwardly to each other. The Schneider U.S. Pat. No. 1,300,030 shows a bow shaped handle onto which is connected a wire hook at each end in order to clasp a package. The Pusey U.S. Pat. No. 609,946 shows a bow shaped handle having cut outs formed at its ends for clasping the string of a package. The Bridwell U.S. Pat. No. 399,180 shows a bow shaped handle having transfer slots at each end to grip the string of a package. The Ottignon U.S. Pat. No. 606,936 shows a bow shaped handle that has an S-curved slot formed in each end. The Castro U.S. Pat. No. 4,666,203 shows a bag carrier consisting of a tubular handle onto which cup hooks are attached to each end. In this patent flexible straps are also provided overlapping the cup hooks in order to restrain the handles of the plastic bag from slipping loose. The Balderree U.S. Pat. No. 2,981,990, shows a bag closure seal. Norway Pat. No. 84,143 shows, a curved metal wire having a wavy midportion with sharply pointed hooks at each end. The Linn U.S. Pat. No. 787,520 shows a curved metal wire having pointed hooks at each end for carrying packages. The Gummelt U.S. Pat. No. 3,797,876, shows a battery carrying handle which is curved with wide end portions and with ribbing in the middle portion which would be gripped by the hand of the carrier. Swiss Pat. No. 224,527, shows a carrying handle which is flat in the middle and has a hook at each end for attaching to a net. Swedish Pat. No. 153,190, shows a carrying handle which has open end portions for carrying a package. The Lane U.S. Pat. No. 891,710, shows a package carrying handle which has a middle portion and an end portion with an outwardly curving hook at each end. The Maccaferri U.S. Pat. No. 2,522,833, shows a handle for being attached to sewn valve bags in which the handle comprises several teeth that dig into the upper portion of the bag. The Williamson U.S. Pat. No. 2,540,068, shows a wire handle for bottle carriers in which there is a central carrying portion connected to two vertically extending prongs. The Schulte U.S. Pat. No. 2,684,797, shows a bow shaped handle having cut outs and prongs formed at its ends for clasping the string of a package. The Parry U.S. Pat. No. 4,772,059, discloses a rectangular shaped carrying handle having a locking loop to close the hooks at the ends of the handle.

Each of these prior art carrying handles has the disadvantage that the string or cord strap carrying means of a shopping bag could readily slip off from the carrying handle, such as whenever the shopping bag is placed on a surface, such as the ground, and the customer releases his grasp of the gripping surface of the carrying handle. Another disadvantage of the prior art is that the construction of the carrying handle, of the prior art, is either very thin or includes sharp pointed corners, so as to greatly increase the likelihood of accident or injury to the hand, or to the clothing of the user that comes in contact with the sharp corners, or the very thin construction of the handle which increases the amount of weight to be carried per unit area.

SUMMARY OF THE INVENTION

It is an object of the present invention to provide a carrying handle for a shopping bag that distributes the weight of the contents of the shopping bag over a larger surface area than that provided by the straps of the bag, so as to prevent injury to the hand of the person carrying the bag.

It is another object of the present invention to provide a carrying handle for a shopping bag which has means for preventing the carrying straps on the bag from becoming unintentionally dislodged from the handle.

In the invention, a plastic molded handle is provided to help in carrying plastic shopping bags that are commonly used in supermarkets, without putting undue stress on the fingers of the hand. The handle is pretzel shaped and has two loops into which the shopping bag straps can be slipped. The handle has the advantage that it prevents injuries to the flesh and joints of the hands of the person carrying these types of shopping bags. The carrying handle is a safe, practical, inexpensive, easily manufactured, and easily stored handle. This handle, though simple in design, has many features to make it a functional solution to this problem. The handle can be manufactured in plastic, metal, or other material, adapted to its purpose, and is economical to produce. The handle takes the weight of the bag or bags and distributes it to the entire hand, and will prevent many injuries to the hand. Since the center of gravity is in the center of the handle, the weight and strain will be passed to the stronger muscles of the arm and shoulder rather than the flesh, bone and connective tissue of the hand. The handle is relatively small in size, and light weight, such that it can easily be carried in a handbag or pocket, without snagging the contents therein. It can be constructed of high weight bearing materials, and thus has a high weight carrying capacity and has an extremely long life span. It can be constructed in many diameters for specific weight, or bulk, considerations. The entry channel bends, so that it can be easily attached and detached to the shopping bag handles.

The handle has a small entry and exit channel, and accidental detachment is virtually eliminated (for example if someone puts the bag down), so that the handle stays attached. Because of its simple nature, its usefulness is tremendous. There are no moving parts to master or complicated clips or clasps, or special twisting angles that have to be used to attach or detach bags or similar type items. The handle has no edges, and thus it will not cut into and bruise the users hands and finger joints. The handle of the invention has, in one embodiment, a horizontally folded back end portion, which provides additional room for the users hands to fit into the handle. Thus, the handle has a big enough diameter and width, so that it does not cut off blood circulation through the hand of the user, whether the user has large hands or small hands. The carrying handle can accommodate more than one bag, especially several bags. The carrying handle enables the bag handles to stay apart and enables the user to pick up several attached bags as a unit, and to be able to place the bags on a supporting surface, such as the ground, and to have the bags not become detached from the handle.

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing wherein similar reference characters denote similar elements throughout the several views:

DESCRIPTION OF PREFERRED EMBODIMENTS

Figure 1:
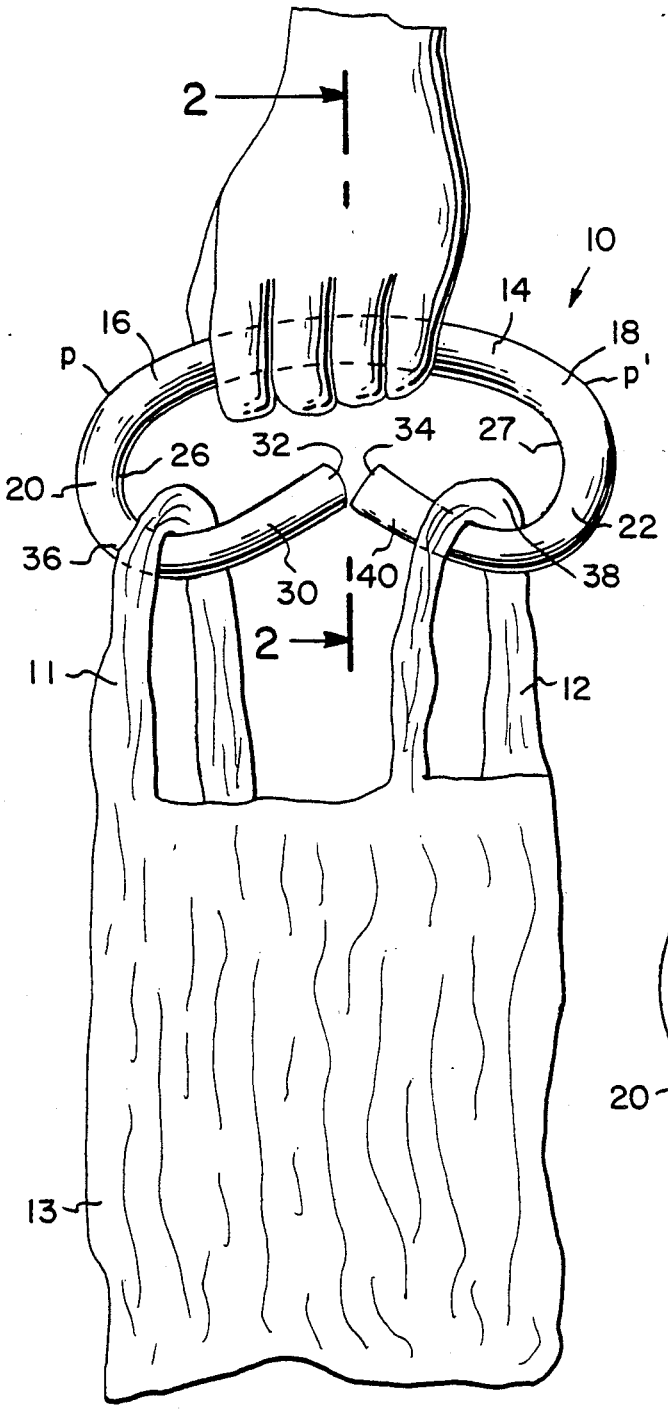
FIG. 1 shows a first embodiment of the carrying handle of the present invention supporting the carrying straps of a shopping bag.

Referring now to the drawings, FIG. 1 shows the carrying handle 10 of the present invention supporting the carrying straps 11 and 12 of a shopping bag 13. The carrying handle comprises a central portion 14 having a first end 16 and a second end 18. There is a first end member 20 integrally attached to the first end; and there is a second end member 22 integrally attached to the second end of the central portion 14. The central portion 14 is an arc with a large radius of curvature, which is shown in FIG. 3 as R, and is designated 24.

Figure 3:
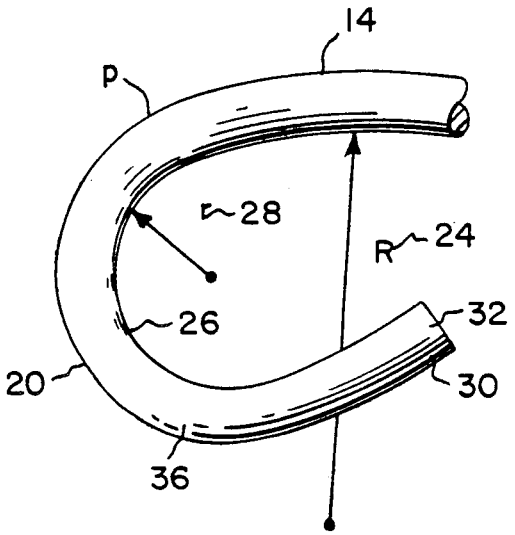
FIG. 3 shows a side view of the carrying handle of FIG. 2.

Each of the first and second end members, 20 and 22, are each J-shaped comprising an arc 26 and 27, respectively, with a small radius of curvature 28, joined to a straight arm portion 30, as shown in FIG. 3.

The first end member and the second end member are shown in FIG. 1 as being directed inwardly toward each other. The central portion 14, the first end member 20, and the second end member 22, are all in the same plane. The central portion 14 is an arc curving toward each of the J-shaped members 20 and 22. Each of the J-shaped members has an arc 26 and 27, respectively, curving toward the central portion 14.

The carrying handle of the present invention would be utilized as follows. A shopping bag 13 containing a number of heavy objects would be placed on a flat surface and each of the handles, 11 and 12, would be slipped between the ends 32 of J-shaped member 20 and 34 of J-shaped member 22. Then one of the carrying straps 11 would be moved to the left while the other carrying strap 12 would be moved to the right, as shown in FIG. 1, such that strap 11 would be residing at the elbow portion 36 of the J-shaped member 20 where the arcuate portion 26 joins the straight portion 30. The strap 12 would be shifted over to position 38 where the arcuate portion 27 of the second J-shaped member 22 joins the straight arm portion 40 of the second J-shaped member. The customer would then grip the central portion 14 of the carrying handle and be able to carry this handle in such a way that the total weight of the objects carried within the shopping bag 13 is distributed over a very large surface area, in order to minimize the discomfort felt by the hand and arm of the customer.

Figure 2:
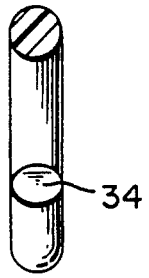
FIG. 2 shows a section view of the carrying handle along line 2—2 of FIG. 1.

FIG. 3 is a side view of the handle of FIG. 2, and shows one transition point P where the central portion 14 of the carrying handle integrally joins the first end member 20. This transition point P is at the first end 16 of the carrying handle central portion 14. This transition point P is created during the manufacturing step of producing the carrying handle wherein a first bend takes place in bending an initially straight cylindrical bar of plastic or metal material, which would be bent such that the first J-shaped member 20 is integrally attached to the central portion 14 of the carrying handle. At location 18 would be a second transition point P', which corresponds to the second end of the central portion 14 at which a second bend is made to the other end of the straight cylindrical bar of solid plastic or metal. This is the manner in which the carrying handle is manufactured such that the central portion 14 would end up with a slight arcuate configuration between points 16 and 18 and have J-shaped members 20 and 22 integrally attached thereto, so as to produce the pretzel shaped carrying handle final configuration. The bending is carried out in such a manner that the ends 32 and 34 are very close together, and are almost touching each other. The handle can also be made by a process of plastic injection molding or other suitable processes.

Figure 5:
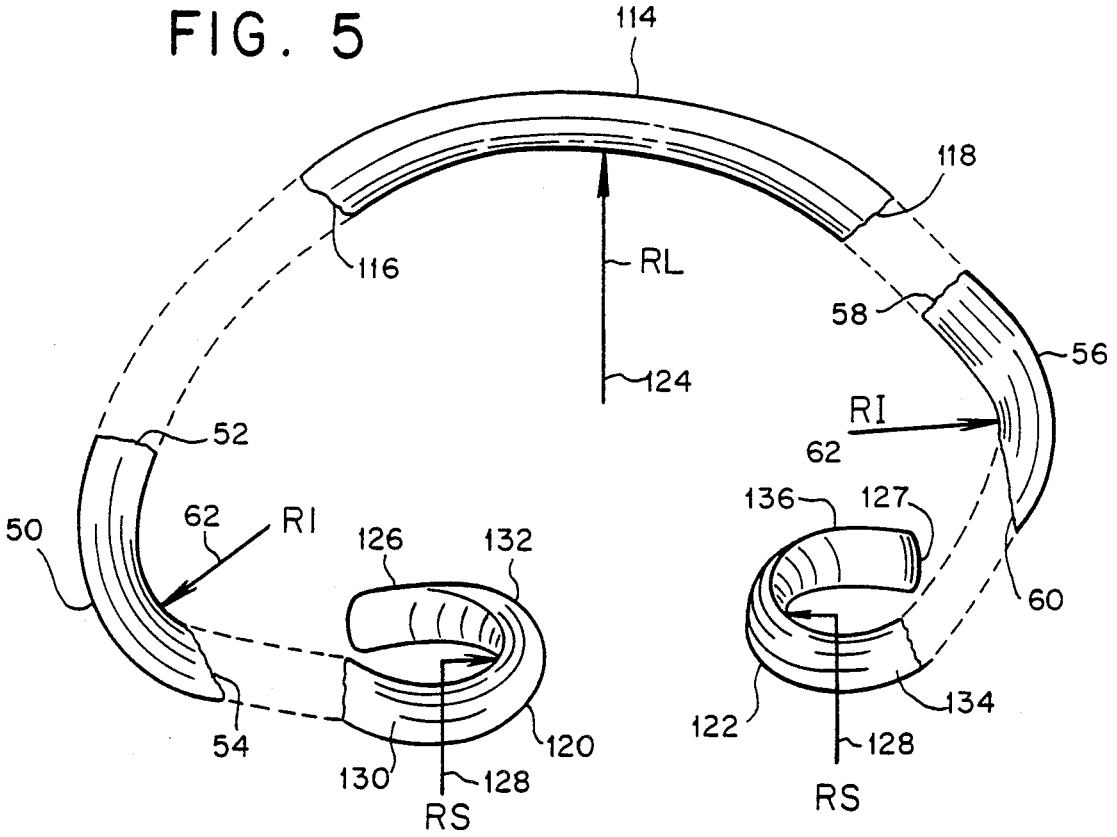
FIG. 5 shows an exploded view of the handle of FIG. 4.
Figure 4:
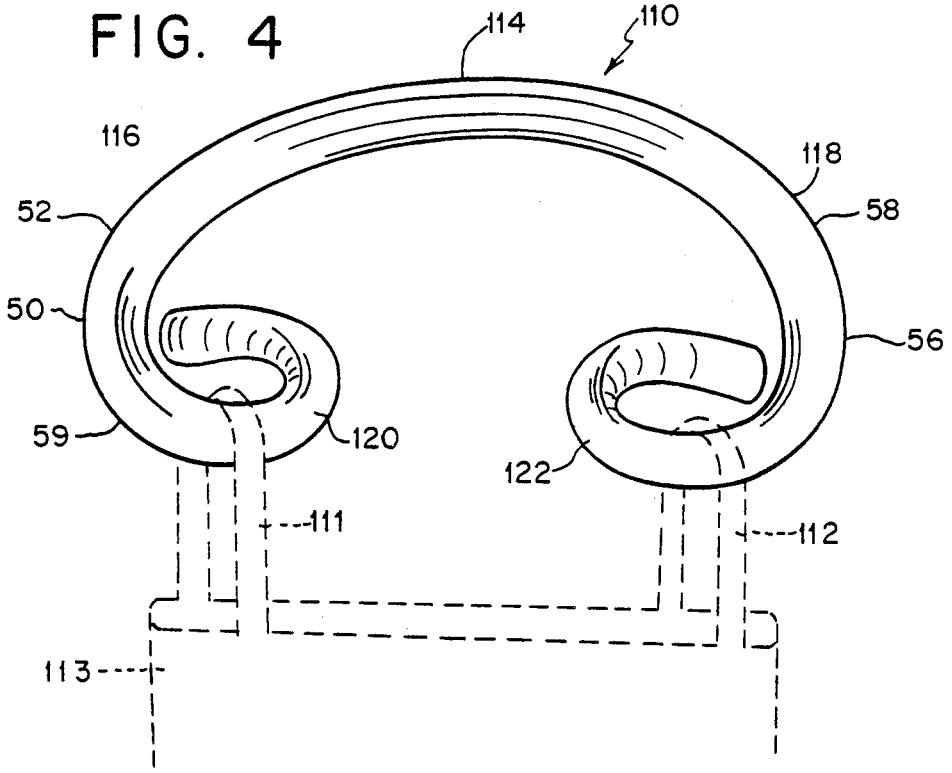
FIG. 4 shows a second embodiment of the carrying handle of the invention.

FIG. 4 shows a second embodiment of the carrying handle 110 of the present invention supporting the carrying straps 111 and 112 of a shopping bag 113. The carrying handle comprises a central portion 114 having a first end 116 and a second end 118. There is a first intermediate section 50 having a first end 52 and a second end 54, with the first end 52 of the first section 50 integrally attached to the first end 116 of the central portion 114. There is a second intermediate section 56 having a first end 58 and a second end 60 with the first end 58 of the second section 56 integrally attached to the second end 118 of the central portion 114. There is a first end member 120 integrally attached to the second end 54 of the first section 50. There is a second end member 122 integrally attached to the second end 60 of the second section 56. The central portion 114 is an arc with a large radius of curvature, which is shown in FIG. 5 as RL, and is designated 124. Each of the first and second intermediate sections is an arc with an intermediate radius of curvature 62, or RI smaller than said large radius of curvature RL.

Each of the first and second end members, 120 and 122, are each U-shaped comprising a centrally located arc 126 and 127, respectively, with a radius of curvature RS or 128 smaller than said intermediate radius of curvature RI, as shown in FIG. 5. Arc 126 of member 120 is positioned between parallel arms 130 and 132; and arc 127 of member 122 is positioned between parallel arms 134 and 136.

The first end member and the second end member are shown in FIG. 4 as being directed inwardly toward each other. The central portion 114, the intermediate sections 50 and 56, the first end member 120, and the second end member 122, are all in the same plane. The central portion 114 is an arc curving toward each of the U-shaped members 120 and 122. Each of the U-shaped members has a horizontally folded back U-shaped bottom arc 126 and 127, respectively, curving toward the central portion 114. Each U-shaped end member bottom arc 126 and 127 is such that the bottom arc of one end member points toward the bottom arc of the other end member.

The embodiment of FIGS. 4 and 5 would be utilized and would be manufactured analogously to the manner described above for the embodiment of FIGS. 1 to 3.

While only two embodiments of the present invention have been shown and described, it is to be understood that many changes and modifications may be made thereunto without departing from the spirit and scope of the invention as defined in the appended claims.

What is claimed is:

1. A carrying handle for supporting a shopping bag and its contents comprising:

a central portion having a first end and a second end;

a first intermediate section having a first end and a second end with said first end of said first section integrally attached to said first end of said central portion;

a first end member integrally attached to said second end of said first section;

a second intermediate section having a first end and a second end with said first end of said second section integrally attached to said second end of said central portion;

a second end member integrally attached at said second end of said second section;

said central portion being an arc with a large radius of curvature;

each of said first and second intermediate sections being an arc with an intermediate radius of curvature smaller than said large radius of curvature;

each of said first and second end members being U-shaped comprising an arc with a radius of curvature smaller than said intermediate radius of curvature;

wherein said first end member and said second end member are directed inwardly toward each other;

wherein said central portion, said intermediate sections, said first end member, and said second end member being continuously curved all in the same plane;

wherein each of said end members comprises a folded back U-shaped arc forming substantially parallel first and second horizontal portions;

said second horizontal portion has a free end which is closely adjacent to the second end of the respective intermediate section to prevent inadvertent disengagement from a shopping bag; and wherein each of said U-shaped members has a convex bottom arc; and said convex bottom arc of each end member points toward the convex bottom arc of the other end member.

* * * * *

UNITED STATES PATENT AND TRADEMARK OFFICE

CERTIFICATE OF CORRECTION

PATENT NO. : 4,991,894

DATED : February 12, 1991

INVENTOR(S) : John Rutens

It is certified that error appears in the above-identified patent and that said Letters Patent is hereby corrected as shown below:

Cover page, column 1, item 76, please delete line 1 in its entirety and substitute therefor —John Rutens, 31-50 140th St., Linden—.

Signed and Sealed this

Eighth Day of October, 1991

*Attest:*

HARRY F. MANBECK, JR.

*Attesting Officer*

*Commissioner of Patents and Trademarks*